US008635833B2

(12) United States Patent
Anderson

(10) Patent No.: US 8,635,833 B2
(45) Date of Patent: Jan. 28, 2014

(54) TOP-DOWN METHOD FOR CONSTRUCTING BELOW-GRADE STRUCTURES

(76) Inventor: Richard Roy Anderson, Kennesaw, GA (US)

( * ) Notice: Subject to any disclaimer, the term of this patent is extended or adjusted under 35 U.S.C. 154(b) by 0 days.

(21) Appl. No.: 13/330,008

(22) Filed: Dec. 19, 2011

(65) Prior Publication Data

US 2012/0159893 A1 Jun. 28, 2012

Related U.S. Application Data

(60) Provisional application No. 61/426,598, filed on Dec. 23, 2010.

(51) Int. Cl.
*E04B 1/00* (2006.01)

(52) U.S. Cl.
USPC ..... 52/745.09; 52/296

(58) Field of Classification Search
USPC ..... 52/741.11, 741.13, 741.14, 741.15, 52/412.05, 745.09, 741.4, 506.01, 294, 52/295, 296, 292, 293.1, 408, 409, 413; 405/272, 273, 274, 275, 276, 279, 229, 405/233, 239, 285, 286, 287, 287.1
See application file for complete search history.

(56) References Cited

U.S. PATENT DOCUMENTS

| | | | | |
|---|---|---|---|---|
| 3,243,963 | A * | 4/1966 | Schnabel, Jr. | 405/272 |
| 5,551,810 | A * | 9/1996 | Franceski et al. | 405/286 |
| 6,241,421 | B1 * | 6/2001 | Harvie et al. | 405/45 |
| 7,017,309 | B2 * | 3/2006 | McNett | 52/169.14 |
| 7,600,948 | B2 * | 10/2009 | Cargill et al. | 405/262 |
| 2003/0156905 | A1 * | 8/2003 | Hubert | 405/229 |
| 2004/0052589 | A1 * | 3/2004 | Lewis | 405/284 |
| 2004/0083670 | A1 * | 5/2004 | McNett | 52/408 |
| 2007/0264087 | A1 * | 11/2007 | Schmitt | 405/233 |

* cited by examiner

*Primary Examiner* — Jessica Laux
(74) *Attorney, Agent, or Firm* — Gardner, Groff, Greenwald & Villanueva, PC

(57) ABSTRACT

An earth retention system constructed with a top-down process that can be used for permanent below-grade structures, similar to a "soldier beam and lagging wall," consists of vertical soldier piles, drainage and waterproofing, and a finished, reinforced concrete facing. The concrete facing is placed pneumatically (i.e., using so-called shotcrete). The system is well-suited to constructing below-grade portions of buildings where excavation lay back is not practical or cost effective and can incorporate permanent lateral support from tieback anchors. The below-grade structure is constructed by excavating down part way, constructing a waterproof "lift" portion of the ultimate structure, excavating down another part way, constructing another waterproof lift portion in a manner to be tied in with the lift portion immediately above, and repeating these steps until the below-grade structure is constructed to the desired depth.

9 Claims, 6 Drawing Sheets

TOP-DOWN METHOD FOR CONSTRUCTING BELOW-GRADE STRUCTURES

CROSS-REFERENCE TO RELATED APPLICATION

This application claims the priority benefit of U.S. Provisional Patent Application Ser. No. 61/426,598, filed Dec. 23, 2010, which is hereby incorporated herein by reference.

TECHNICAL FIELD

The present invention relates generally to the construction industry and, in particular, to the construction of below-grade concrete structures, such as foundation walls.

BACKGROUND

In the construction of in-ground foundation walls for large buildings, it is typical to dig out (excavate) the earth to the desired depth of the foundation and then build up the foundation walls from the bottom up. Unfortunately, if the foundation wall is large, this can require some substantial shoring of the earth to prevent cave-ins (which are a serious safety risk). The use of temporary shoring structures to prevent cave-ins of the earth adjacent the excavation adds considerably to the cost and time required to construct in-ground foundation walls for large buildings. In addition, if the foundation walls are constructed from the bottom up, extensive scaffolding typically is employed to provide access to the upper reaches of the foundation wall. This scaffolding adds to the complexity and cost of constructing the foundation walls and does not completely eliminate the risk of falling workers (or equipment falling on workers below).

Accordingly, it can be seen that a need exists for an improved method for constructing large in-ground foundation walls. It is to the provision of such that the present invention is primarily directed.

SUMMARY

Generally described, the present invention relates to a method of constructing a foundation wall system in the ground. The method is a top-down construction approach, rather than a bottom-up approach. Preferably the method comprising the steps of: (1) installing a series of spaced-apart vertical structural steel beams in the ground; and (2) beginning from the top and working downwardly, making the foundation wall in multiple horizontal sections, one horizontal section at a time from top to bottom. Preferably, each horizontal section is made by: (a) constructing a first wall portion spanning the vertical structural steel beams; (b) applying a waterproof cladding to the first concrete wall portion; and (c) constructing a second concrete wall portion spanning the vertical structural steel beams such that the waterproof cladding is sandwiched between the first concrete wall portion and the second concrete wall portion.

Defined another way, the present invention comprises an earth retention method and system constructed with a top-down process that can be used for permanent below-grade structures. The finished product comprises a series of vertical soldier piles, drainage and waterproofing, and a finished, reinforced concrete facing. The concrete facing is placed pneumatically (i.e., using so-called shotcrete). The method and system is well-suited to constructing below-grade portions of buildings where excavation lay back is not practical or cost-effective and optionally can incorporate permanent lateral support from tieback anchors.

The below-grade structure preferably is constructed by excavating down part way, constructing a waterproof "lift" portion of the ultimate foundation structure, excavating down another part way, constructing another waterproof lift portion in a manner to be tied in with the lift portion immediately above, and repeating these steps until the below-grade foundation structure is constructed to the desired depth. Preferably, the depth of each lift is selected to be scaled comparable to the height of a typical construction worker, such that the construction workers can conveniently and easily complete their tasks without the use of ladders, stools or scaffolding. Thus, preferably the depth of each lift is approximately 5 or 6 feet high.

Preferably, the method further comprises the step of constructing an outer wall in the excavated space spanning the vertical structural steel beams, and wherein the step of positioning the waterproof cladding includes applying the waterproof cladding against the outer wall, such that when the concrete wall portion is constructed, the waterproof cladding is sandwiched between the concrete wall portion and the outer wall.

The method preferably comprises excavating down between about 5 and 6 feet to provide a limited excavated space for constructing a portion of a concrete wall. Preferably, the step of constructing the concrete wall portion comprises positioning steel reinforcing bars and then spraying the steel reinforcing bars with liquid concrete (shotcrete). Moreover, it is preferred that the step of positioning steel reinforcing bars comprises welding shear studs to the vertical steel beams at regular intervals and supporting a grid of steel reinforcing bars upon the shear studs.

Optionally, one can excavate a continuous shallow trench about 1 to 2 feet deep at the bottom of the excavation adjacent to where the wall is being constructed to allow vertical overlapping of drainage, waterproofing and reinforcing steel from one horizontal section to another.

Preferably, a concrete lagging wall is installed and a prefabricated drainage composite material is placed behind the concrete lagging wall is positioned adjacent the concrete lagging wall to prevent the build-up of excess hydrostatic pressure behind the concrete lagging wall. Alternatively, the lagging wall can be omitted or a lagging wall can be constructed of wood or other materials, as desired.

Advantageously, the methods and system of the present invention can greatly facilitate construction of in-ground foundation walls, particularly large in-ground foundation walls. In this regard, the present methods and system allow the construction of the in-ground foundation wall more quickly, more cheaply, and more safely. Regarding safety, the construction workers are able to construct the wall while standing on earth, rather than standing on scaffolding, ladders, stools, etc. Thus, the portion of the wall being constructed is maintained at the level of the construction worker, which greatly contributes to worker safety, convenience, comfort, etc. In addition to making the construction of the foundation wall safe and convenient, the methods and system of the present invention avoid the need for the use of temporary shoring, since only several vertical feet of exposed, unsupported earth face are present at any one time. Note that below the workers' feet, the ground is not yet excavated. Moreover, the upper lifts or horizontal sections of the foundation wall already so constructed are tied into and supported by the vertical steel beams placed in the ground. Thus, only several vertical feet of earth are exposed at any one time, greatly reducing the risk of cave-ins and limiting the need for temporary shoring. Also, the workers are working at their own level and do not need to move about on scaffolding or ladders to reach the work area.

The specific techniques and structures employed to improve over the drawbacks of the prior devices and accomplish the advantages described herein will become apparent from the following detailed description of example embodiments and the appended drawings and claims.

DETAILED DESCRIPTION OF EXAMPLE EMBODIMENTS

Generally described, the present invention relates to a method of constructing a foundation wall system in the ground. The method is a top-down construction approach, rather than a bottom-up approach. Preferably the method comprises the steps of: (1) installing a series of spaced-apart vertical structural steel beams in the ground; and (2) beginning from the top and working downwardly, making the foundation wall in multiple horizontal sections, one horizontal section at a time from top to bottom. Preferably, each horizontal section is made by: (a) constructing a first lagging wall portion spanning the vertical structural steel beams; (b) applying a waterproof cladding to the first lagging wall portion; and (c) constructing a second concrete wall portion spanning the vertical structural steel beams such that the waterproof cladding is sandwiched between the first lagging wall portion and the second concrete wall portion. Moreover, preferably, as the sections are constructed from top to bottom, the vertically-adjacent sections are tied together in such a way to provide excellent structural integrity, as well as effective water-proofing.

Figure 1:
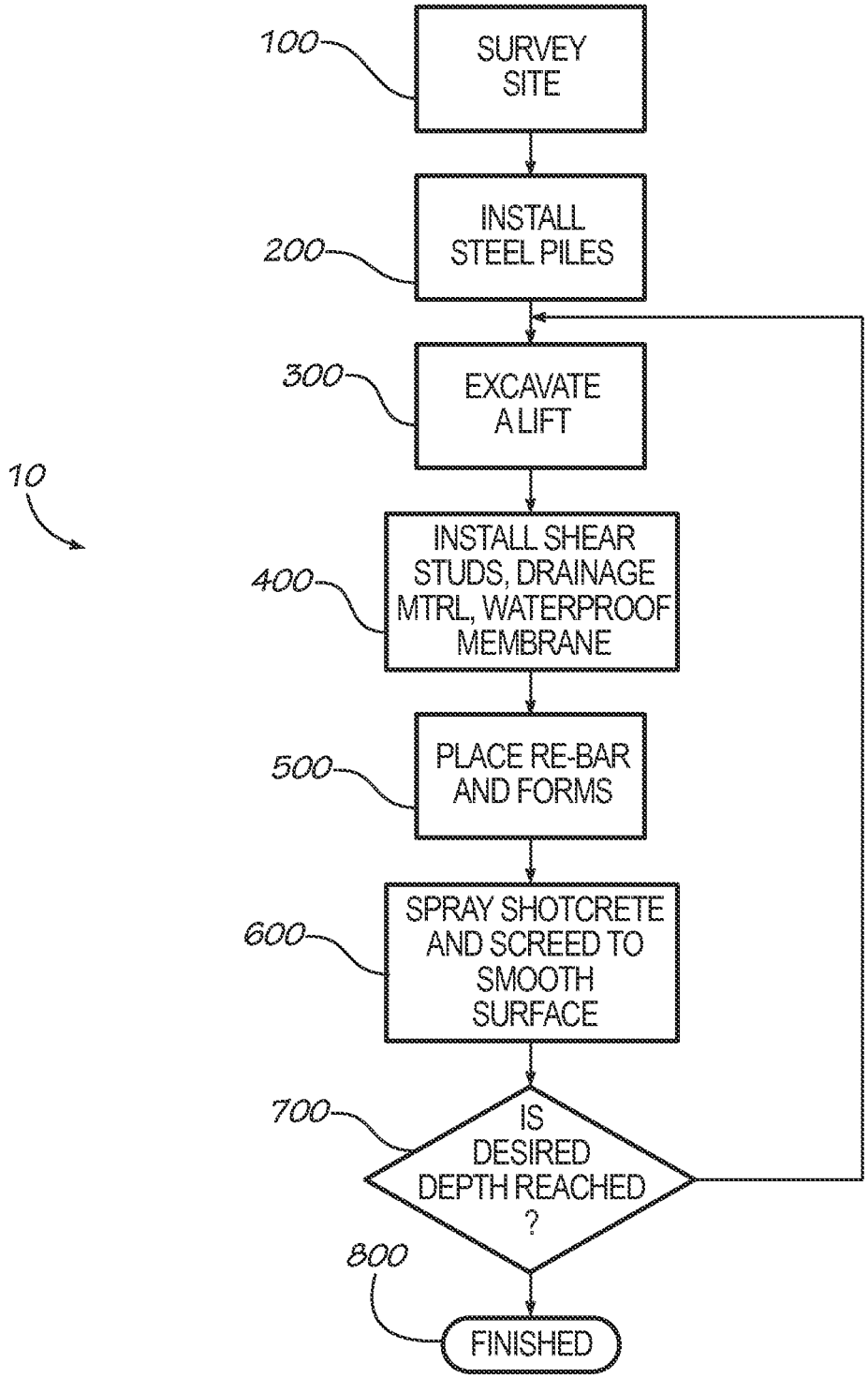
FIG. 1 is a schematic flow chart of a method of constructing below-grade structures according to a first example embodiment of the present invention, showing steps for carrying out the method.

FIG. 1 shows a schematic, high-level flow chart depicting a method 10 of constructing below-grade structures according to a first example embodiment of the present invention, showing steps for carrying out the method. As shown therein, the first step 100 in the process is to survey the site to lay out the position of the foundation wall(s) and steel pilings. The next step 200 is the installation of the steel pilings. This is followed by step 300, the excavation of a first "lift" (a vertical excavation of some 4-8 feet, typically 5-6 feet extending laterally as far as needed). In step 400, shear studs are welded to the steel pilings, a drainage material is positioned in place between the steel pilings, a concrete (or other material) lagging wall is positioned or formed between the steel pilings against the drainage material, and a water-proof membrane is positioned against the lagging wall. In the next step 500, steel reinforcing bars (rebar) is positioned upon the shear studs to form a reinforcing grid work and some temporary forms are positioned to prepare for receiving concrete. Next, in step 600 liquid concrete, preferably so-called "shotcrete", is sprayed from a hose over the grid work of rebar and within the forms to create a sprayed-in-place concrete wall section, the inside face of which is then smoothed if desired. If the desired depth has been reached, the work moves through decision step 700 to the end 800. Otherwise, if the desired depth has not yet been reached, the process loops back to step 300 and another lift is excavated, followed by the construction of another horizontal strip of wall according to steps 400-600. This is repeated as many times as needed until the desired depth of the foundation wall has been attained.

The novel construction method and earth retention system has several advantages over more conventional methods of below-grade construction. One advantage is greater schedule speed because the system is constructed from the top down, avoiding the need to dig all the way down in order to begin work (and then work all the way back up). Therefore, when the excavation reaches the final bottom elevation, the earth retention system (final below grade wall) is complete. With other shoring methods, the finished below grade wall would be constructed from the bottom up after the final elevation is reached, requiring a longer construction period. A second advantage is cost. With the present method and system, the process combines temporary excavation support and the finished, permanent below-grade wall. By combining the two into one system, the cost is often reduced by not having to construct the two components separately. A third advantage is that the system incorporates drainage behind the concrete facing, as well as a waterproofing membrane behind the concrete facing, or internal waterproofing within the concrete. This allows the system to be used where the interior is a finished space that is sensitive to moisture.

The system uses discrete vertical structural elements (soldier piles) spanned by reinforced concrete lagging. As with conventional shoring systems, the system is suitable for most ground types; however, it may not be suitable for cohesion less soils that have limited "stand-up" time for lagging construction. The following outlines a typical, example construction process of the method and system.

Step 100—Site Survey—Typically, the H-pile locations are laid out by a registered land surveyor in preparation for the installation of the H-piles.

Step 200—Installation of Soldier Piles—Soldier piles are the vertical structural elements that collect earth loads from the lagging (i.e. wall facing) and transfer them to lateral support components of either tieback anchors or the internal building structure. Soldier piles can consist of steel piles (h-piles, wide flange sections or pipes) or concrete piles (pre-cast or cast-in-place). Steel or pre-cast piles can either be placed in pre-drilled pilot holes and backfilled with lean concrete or can be driven in place. Cast-in-place concrete piles would be constructed in predrilled holes.

As shown in the example depicted in FIGS. 2A-2E, the soldier piles 101-105 are installed at regular intervals around the perimeter of the planned excavation prior to commencement of the excavation. The face of pile is set back from the planned face of wall location by the design thickness of the concrete facing and waterproofing. The soldier piles are installed to a depth below the planned bottom of excavation as determined by the structural design of the excavation support system.

Figure 2A:
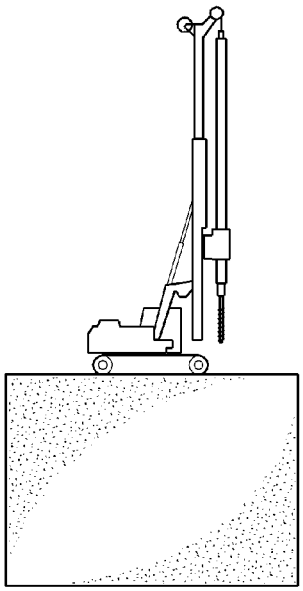
FIGS. 2A-2E are schematic illustrations of a step portion of the method of FIG. 1, showing the installation of vertical structural steel beams/soldier piles in the earth.
Figure 2B:
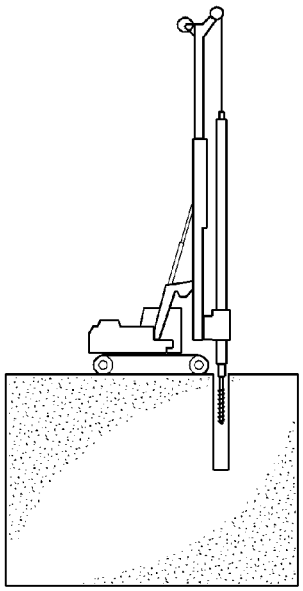
Figure 2C:
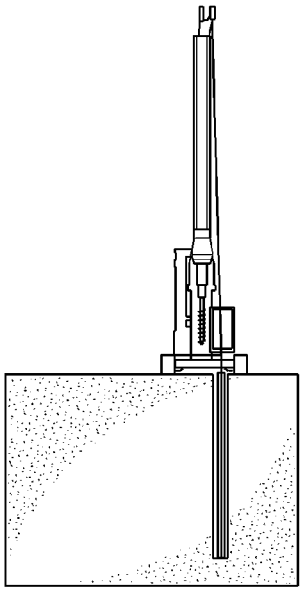
Figure 2D:
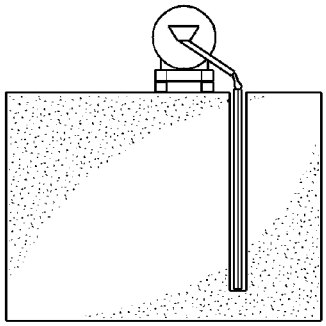
Figure 2E:
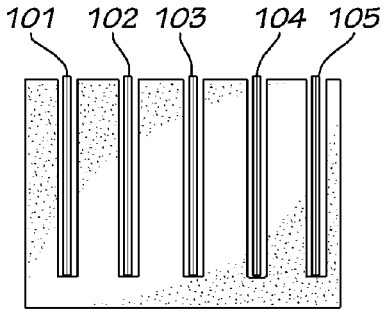

Once the H-pile locations have been laid out by a registered land surveyor, the pilot hole is drilled (or driven) to the design bottom of pile elevation (see FIGS. 2A-2B). The H-pile section is then lowered into the pilot hole plumb (vertical) and filled with a low-strength flowable fill (typically, low-strength concrete with a rating in the range of about 400 to 700 PSI). See FIGS. 2C-2D. This step is repeated until all of the H-pile sections are installed (FIG. 2E).

Optionally, if required for the particular site or job, a grade beam or cap beam can be created at the top of the shoring wall. Typically, the cap beam spans continuously at the top of the wall and through the H-pile sections where it protrudes out of the top of the permanent wall to temporarily retain soils behind until they are excavated back at a later time. The grade beam generally will include continuous longitudinal reinforcing bars with stirrups installed on-centers. The stirrups may protrude from the top of the grade beam several inches to tie in a capping slab at a later time.

To construct the grade beam continuously with the protruding H-pile sections extending above grade, small diameter holes (depending on the rebar size being used) can be burned through the piles where the continuous longitudinal rebar is located for the grade beam. The stirrups can be installed as required and the grade beam can be either poured against the earth or formwork can be built around it to accommodate the required dimensions.

Figure 3A:
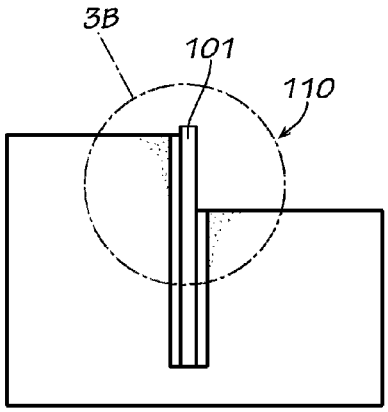
FIGS. 3A-3B are schematic illustrations of a step portion of the method of FIG. 1, showing the excavation of earth for an initial lift.

Step 300—Excavation of Initial Lift—After installation of the soldier piles, the general excavation commences. Note, that depending upon soil conditions at a particular site and the local geography, it may be necessary or advisable to utilize wood lagging to retain collapsible soils during an excavation. The excavation is typically made in 5-foot deep lifts, but this may vary depending on the soil type and construction requirements. See FIGS. 3A-3B. The depth of the lift 110 is indicated generally as L. The general idea behind using 5-foot lifts is to make an excavation that allows for easy work by the construction workers without requiring ladders, scaffolding, etc, and which generally avoids the need to temporarily shore up the earth face where the workers are working. In this regard, note that if the excavation were thirty feet deep, substantial shoring would be required in order to protect the workers from the substantial hazard of such a high unsupported earth face. Moreover, to work at the top of a thirty foot excavation would require very long ladders and/or high scaffolding. The present invention avoids these problems by breaking the excavation down into sections scaled to the general working range of a human worker and scaled to minimize or avoid the need for temporary shoring. In this regard, the five foot depth of the excavation lift is not inflexible. Indeed, excavation lifts from a few feet to perhaps as much as eight feet work well. The more preferred range is between about four and six feet, with the most preferred excavation lift depth being about five feet.

Figure 3B:
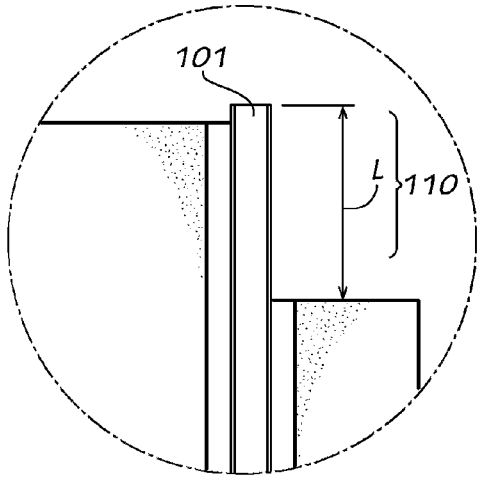

The earth is excavated flush with the interior face of the soldier piles to create a first lift 110 (see FIG. 3B). The earth surface should be vertical and smooth to receive the drainage and/or waterproofing membrane. Loose soils may be present at the top of the excavation and the initial lift may require some additional preparation to obtain a vertical smooth surface. The additional preparation may require the use of timber lagging, wood forms or a thin unreinforced shotcrete layer. Also, it may be necessary to construct forms to create a "finished" top of wall. The top of wall should be configured to allow termination of the wall waterproofing or connection to other waterproofing at the top of the wall. These details will vary depending on the architectural and structural design of the building or structure.

Once the flowable fill surrounding the H-piles has had ample time to set (at least 12 hours), the first excavation lift is made. This lift 110 is typically in the range of about 4 to 6 feet, as previously described. If good soil conditions are present and the soil is self-supporting with some degree of cohesion (e.g., SM, ML, CL type soils generally), then no wood lagging may be needed.

Once excavated, the soils can be removed some 2-4 inches behind the face of the pile to create a "cavity" within each bay (between two H-piles) to be filled with an initial waterproofing and shotcrete mudsill layer. The purpose of the mudsill layer is to provide a smooth even surface on which to apply the waterproofing detail and may or may not be required depending on the jobsite. If the mudsill is not required, some of the following steps may be skipped.

If the soil is loose or not self-supporting, then wood lagging, which typically consists of 3"×10" treated wood boards, can be placed in front of, within or behind the flanges of the H-pile and spans horizontally to the next adjacent pile. This process is repeated until the entire exposed excavation lift is braced with such lagging.

Figure 4A:
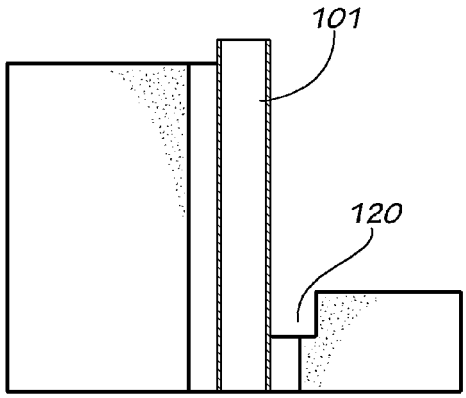
FIGS. 4A-4C are schematic illustrations of a step portion of the method of FIG. 1, showing the preparation of the initial excavation lift of FIGS. 3A-3B for receiving a concrete wall portion.
Figure 4B:
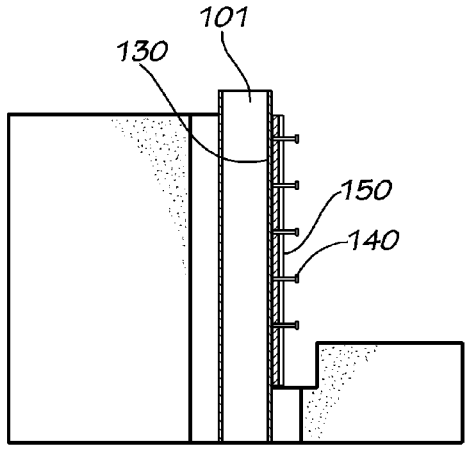

As shown in FIG. 4A, a continuous shallow trench 120 is excavated parallel to the face of the wall (and parallel to the face of pile 101), typically 12 to 18 inches deep. The purpose of the trench 120 is to allow overlapping of drainage, waterproofing and reinforcing steel with the subsequent lift of the retention system.

The next step is to install an optional initial layer of drainage board material within the 2-4" deep cavity between the pile bays. This material is installed vertically up against the exposed face of the soil or lagging with the filter fabric side facing toward the soil/lagging. Both sides of the drainage board and the top are wrapped with filter fabric to prohibit soil fines from entering and causing it to clog. The board should be placed flush against the surface with minimal air pockets or voids behind it. It is then secured with nails or soil nails. The 4-foot wide drainage board may be centered within each bay or may be cut into two 2-foot wide pieces and butted up against the H-piles within each bay. Once again, the top and side edges should be wrapped with filter fabric. PVC pipe weep holes (diameter dependent upon anticipated hydrostatic conditions behind the wall) can be installed, as desired, at on-center locations vertically and horizontally within each bay by making a hole slightly greater in diameter than the size weep hole pipe being used in the plastic portion of the drainage board without damaging the filter fabric behind. The weep hole pipe is set into the hole and held in with soil nails. The open side of the pipe is temporarily covered, as with duct tape, to protect it during the placement of the initial shotcrete mudsill layer. This pipe preferably is long enough to protrude a small distance (typically 1 to 2 inches) out of the mudsill layer to be later cut flush with the face of the mudsill shotcrete layer. The drainage board is installed to fit the height of the lift with a small amount of drainage board material (about 6 inches) at the bottom and then covered and protected with soil at the bottom to tie it into the next underlying lift when it is excavated.

The next step is the placement of the initial shotcrete mudsill layer. This consists of a layer of lean shotcrete sprayed to fill the "cavity" between the piles. This layer can be thick or thin, as desired. Generally, a layer of about 2-4 inches has been found to work well. Once it is sprayed on, it is screeded flush with the face of the H-piles. This produces a smooth even surface upon which to apply the main waterproofing detail.

Step 400—Installation of Shear Studs, Drainage Composite and Waterproofing Membrane—Drainage behind the concrete lagging is provided by the previously-described prefabricated drainage composite. The drainage composite is designed to be compatible with the type of soil being retained and the expected groundwater conditions. The purpose of the drainage composite is to prevent the build-up of excess hydrostatic pressure behind the wall. The composite is placed continuously over the excavated earth face and extends below the base of the lift into the shallow trench to allow it to lap behind the next lift.

Once the mudsill has dried (at least 12 hours) the installation of the main waterproofing detail may begin. First more drainage board material 130 is installed starting several inches from the design Top of Wall Elevation. The drainage board material is secured with nails at all four corners flush with the mudsill or surface behind. The nails should be located at least 2-3 inches inside of the edges so that the weight of the material does not pull it loose from the wall. The top nails should be installed first, the material pulled somewhat tightly down at the bottom to ensure contact with the surface behind and then the bottom nails installed. Once again, the filter fabric side of the drainage board material should be against the surface behind. If the drainage board has polymeric film, then the film side will be towards the finished face of wall. The drainage board typically is installed only between the H-pile bays and does not span over the H-piles. The material should be spliced together at joints by butting the pieces together with an underlying piece of filter fabric. A sufficient amount of material (approximately 6 inches) preferably should be left at the bottom of the current lift to tie into the next underlying lift once the excavation is made.

Headed shear studs 140 preferably are welded to the vertical face of the soldier piles at regular spaced-apart intervals. The headed shear studs provide a structural connection between the concrete facing to be placed later and the soldier piles. The size and spacing of the shear studs is determined by the structural design of the foundation system. Once the welds have cooled down, the faces of the H-piles can be prepared for receiving a waterproof membrane. To do so, the H-piles should be cleaned of any loose dirt or debris and primed with a liquid adhesive coating solution. A protective two-sided tape covering is then applied over the primed surface.

If a membrane is used for waterproofing, it is installed at this point in the process. There are a number of commercially available waterproofing membranes that can be used for this application, commonly referred to as "blindside" waterproofing. The membrane 150 is placed continuously over the drainage composite and over the soldier piles and is extended into the lap trench 120. The membrane manufacturer's procedures and details for waterproofing should be followed. These include attachment of the membrane to the vertical surface, treatment of vertical and horizontal laps, waterproofing around shear studs and other protrusions/penetrations, termination of the membrane and repair of incidental damage to the membrane.

The optional installation of the blindside waterproofing membrane 150 typically includes cutting the material to fit the height of the lift from top to bottom, except in the first lift where it will start several inches from the design "Top of Wall" elevation (same elevation as the drainage board beneath). Unlike the drainage board material, the blindside membrane 150 spans continuously over the H-beams and bays therebetween. Slots are cut into the material to allow the headed studs to protrude through. Preferably, the material overlaps vertically about 4 inches and horizontally about 6 inches. It can be secured with nails along the top at about 12 inches on-center. Similar to the drainage board, it should also be pulled at the bottom to ensure contact with the surface behind/drainage board material beneath. Once it is pressed against the surface it can be nailed, such as at 24 inches on-center, along the vertical laps. A sufficient amount of material (approximately 12 inches) should be left at the bottom of the current lift to tie into the next underlying lift once the excavation is made.

Where the blindside membrane 150 has been cut to allow the headed studs to protrude through at the H-piles, a 12 inch wide strip of adhesive fabric tape can be applied over the H-piles. This is achieved by first priming the underlying blindside membrane with a liquid adhesive coating solution and allowing it several minutes to become tacky. Once the material has become tacky the fabric tape is then applied over the H-pile face with slots cut into it to allow the headed studs to protrude through. This type of fabric tape can also be applied at horizontal joints between vertically adjacent lifts.

Optionally, the next step can include priming and application of a mastic (sealant) over all penetrations, nails, holes, joints and laps. A liquid adhesive coating solution is first applied to all penetrations, nails, holes, joints and laps and allowed some time to become tacky. Once this has been achieved the mastic is mixed and then applied to all the above mentioned areas using a caulking gun or trowel. Sufficient time (approximately 20 to 30 minutes when temperatures are above 40 degrees Fahrenheit) should be allowed for the material to dry.

An optional termination bar (not shown) can be located within the top lift just below the starting point of the drainage board and waterproofing membrane. This metal strip is secured into the grade beam/mudsill layer/surface beneath using nails at 12 inches on-center in the existing precut holes in the bar. The termination bar spans over the H-piles. Once securely nailed, the termination bar should be covered at the top of the bar with the mastic (sealant) material.

Figure 9:
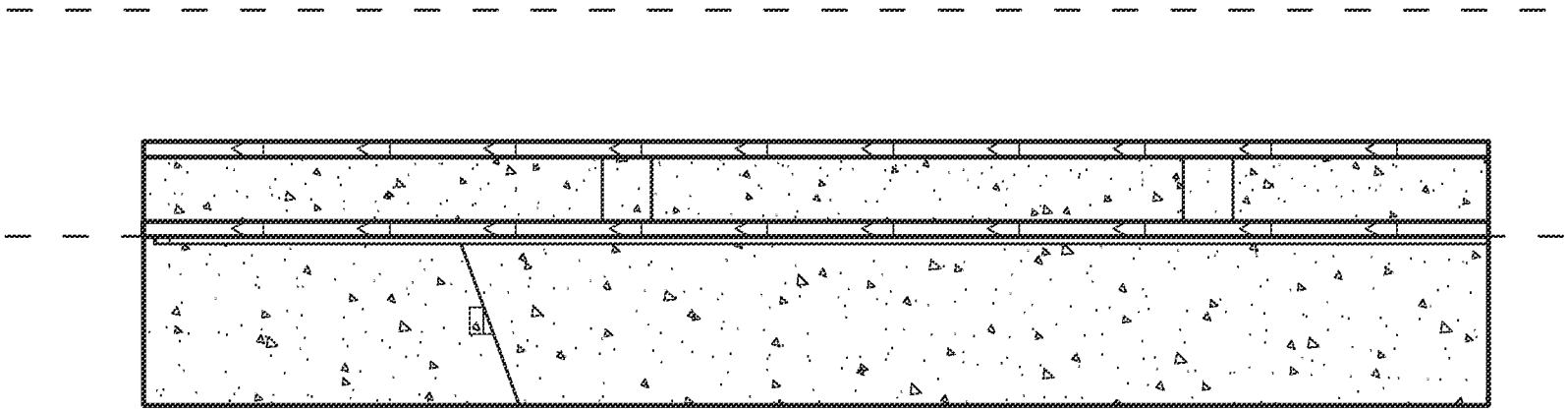
FIG. 9 is a schematic, side sectional view of an example of a portion of an in-ground foundation wall constructed according to the method of FIG. 1 and showing an angled joint construction where a first, upper portion of the foundation wall meets a second, lower portion of the foundation wall.

A chamfered 2×4 is installed at each vertical construction joint before the final application of shotcrete to form a keyway for tying in to the next adjacent section. The chamfered 2×4 is removed after the concrete has set, leaving an elongated groove 210 in the concrete in which to install elastomeric water stop (gasket or seal) 220. See FIG. 9. The water stop 220 is installed within the groove 210 prior to creation of the next vertically adjacent shotcrete section. At each subsequent underlying lift, a water stop is also installed continuously horizontally along the bottom to provide an extra water seal at these construction joints. The water stop 220 is secured with nails to the concrete in the wall section above at approximately 12 inches on-center.

Figure 4C:
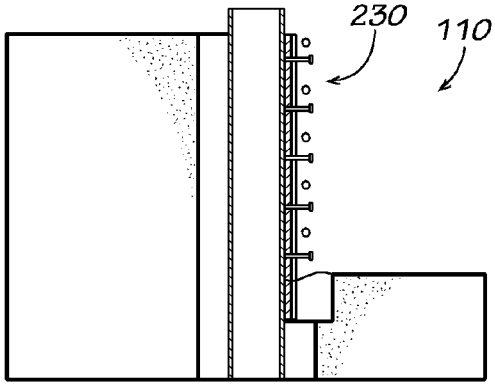
Figure 5:
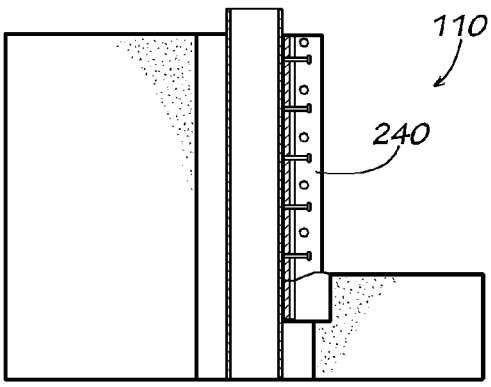
FIG. 5 is a schematic illustration of a step portion of the method of FIG. 1, showing the placement of shotcrete (pneumatically-applied liquid concrete) to the initial excavation lift of FIGS. 3A-3B, forming a concrete wall portion.

Step 500—Placement of Reinforcing Steel—Once the waterproofing has been installed, the bottom of the lift can be backfilled with approximately 12 inches of soil to cover the area to be lapped into the subsequent underlying lift as shown in FIG. 4C. Once the soil has been placed up against the wall, a bottom and top form can be constructed. The top form can be secured to the top of the grade beam/H-pile or by other means and the bottom form is placed on the backfilled soil at an angle of about 15 degrees (FIG. 4C). The sloped angle of the bottom form makes it easier for the nozzle man to fill in the subsequent shotcrete wall lifts by not having to crouch down and shoot upwards as much as one would have to with a completely horizontal bottom surface. This angled or sloped joint also makes for a better water seal, as the slope is oriented to cause any water in the joint to move away from the interior space. The bottom and top forms are cut to provide an even wall thickness all the way across the lift. To ensure a level bottom surface, the bottom formwork can be installed using a laser level.

Once the formwork is complete the reinforcing steel grid 230 is installed. The reinforcing grid 230 generally includes a single mat or grid of horizontal and vertical reinforcing bars, but the nature and extent of the reinforcing grid will depend on the structural requirements of the wall. The vertical (temperature) bars are generally driven 1 foot deep into the subsequent underlying layer for lapping. One to two inches of clearance between all reinforcing steel preferably is maintained to allow the shotcrete to fill all areas between the bars. Additionally, at the top of the wall vertical dowels may be installed to protrude from the top of the permanent shotcrete wall to tie into a future capping slab.

Step 600—Concrete Placement—The final step to complete the first lift 110 placement of the concrete layer 240. The concrete is placed using pneumatic methods and equipment, commonly referred to as "shotcrete." If waterproofing of the system is desired to be accomplished using a waterproofing admixture, it can be incorporated into the concrete mix. A number of waterproofing admixtures are commercially available. They typically consist of a crystalline material that reduces the permeability of the concrete.

The strength of the shotcrete mix generally is dictated by the structural design of the facing, but typically is in the range of 3000 to 5000 psi. American Concrete Institute (ACI) specifications and guidelines for placing shotcrete should be followed. The inside surface of the shotcrete (final wall surface for the structure) can be finished according to the requirements of the project. The finish could range from a rough screeded surface to a smooth troweled surface, as desired. After the lift 110 is finished, proper concrete curing procedures should be followed.

Typically, a normal strength concrete mix (generally about a 4000 psi mix) is applied to the wall in multiple lifts. The nozzle man will usually begin the application starting in a corner and building the shotcrete from the bottom up and outwardly from the side. The nozzle man should be careful not to let the wet shotcrete become too heavy in any one area to cause sloughing of the shotcrete. Normally the bottom is filled first, followed by several inches of a back layer about ⅔ of the way up. The nozzle man continues down the wall in this manner applying the shotcrete until the lift has begun to dry some. Once he has determined the area is capable of holding the next layer he will begin to build on the previous layer. This process is continued until the whole wall cavity is filled with shotcrete (number of passes is dependent on design wall thickness, generally in the range of 3 to 6 passes). During this process, concrete finishers are removing any loose shotcrete from the application area. In subsequent underlying layers, plywood attached to wood 2×4's is used to protect the finished wall above from overspray (the wall in a lift above is protected from overspray during the creation of a wall section below by the temporarily placed plywood). Once all the shotcrete has been applied, concrete finish workers then screed the face of the wall to achieve an even surface using the top and bottom forms as a guide. Optionally, the surface is troweled and then given a wet sponge finish for a "stucco" appearance. Different finishes and coloring can be applied depending on the architect's/owner's requirements/instructions. Finally, the shotcrete is sprayed with a chemical curing compound and allowed to set prior to excavating the next subsequent underlying 5 to 6 foot lift.

Step 700—Construction of Subsequent Lifts—After completion of the first lift 110 of the system, subsequent lifts are made generally following the steps outlined above. Once the newly sprayed lift has had time to set (at least 24 hours), the next 4 to 6 foot lift is excavated. The above-stated steps are repeated with some minor differences. Once the first lift has been sprayed there is no longer a need to install formwork at the top of the lift as the previously sprayed lift of shotcrete above is used as a "top form" to spray against. Therefore, only the bottom formwork is installed. In addition, no termination bar is used.

In general, laps of the drainage composite and waterproofing membrane are performed according to manufacturer recommendations. Reinforcing steel laps are made per the structural design of the facing. Also, drainage board material is butted together with an underlying piece of filter fabric. The blindside membrane is lapped 6 inches on horizontal lifts with nails installed at about 12 inches on center. The lapped area is then primed with liquid adhesive coating solution and allowed several minutes to become tacky. Once tacky, the primed area is then covered with a 12" wide piece of fabric tape. The fabric tape is then primed with the liquid adhesive coating solution and the seams are covered with mastic.

Tieback anchors are structural elements that are sometimes installed from the face of a retention system into and beyond the earth being retained. Their main purpose is to provide temporary or permanent support of the earth retention system. The earth loads induced by the excavation are transferred to soldier piles by the concrete lagging. The soldier piles, in turn, transfer the loads to the tiebacks. The tiebacks then transfer the loads to the earth beyond the zone of influence of the excavation. The tiebacks are pre-stressed to their design load after they are completed and prior to advancing the excavation. There are numerous types of tieback anchors that can be used ranging from steel tendons and bars that are grouted into the soil to mechanical types such as helical and expansion anchors.

If required by the system design, tieback anchors can be installed during the lift construction process. Depending on the foundation wall design, tiebacks could be placed at any depth below the top of the wall more than a few feet. Tiebacks typically are installed after excavation of a lift, but before installation of the drainage composite and subsequent components.

Temporary tiebacks are used when the earth pressures associated with the excavation can be internally supported by the finished building structure. For temporary tiebacks, the anchorage at the head of the tieback is placed at the interior face of the concrete lagging. A PVC pipe is used to sleeve the tieback through the concrete lagging. This allows access to the tieback so that it can be de-tensioned when the building structure is in place and capable of supporting the lateral earth loads. Permanent tieback anchors are used when the finished building will not be used to support the earth loads. The anchorage head for permanent tiebacks is placed against the soldier pile and is covered by the concrete lagging. This protects the anchorage from corrosion and incidental damage. Adequate corrosion protection is also provided for the portion of permanent tieback anchor that is embedded in the earth.

Figure 6:
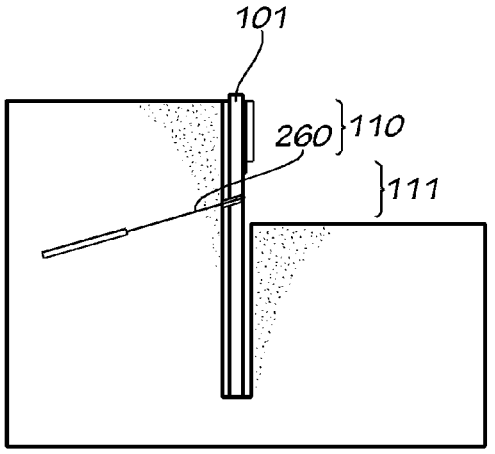
FIG. 6 is a schematic illustration of a step portion of the method of FIG. 1, showing the excavation of a second lift and the optional installation of a tieback reinforcement/anchor.

For use in the present method and system, permanent tieback anchors, if employed, preferably are installed through the soldier piles (see FIG. 6 which depicts a tieback installed in a second lift 111 before the second wall section is formed beneath the first wall section in lift 110). A hole is cut through the pile 101 to accommodate installation of the tieback 260. Preferably, the pile can be structurally reinforced at the through-beam hole location. The tiebacks consist of a through-beam connection where a small diameter hole (generally around 5 inches in diameter) is cut through the front and back of the H-pile section at the design angle to allow the drill rig to penetrate through the beam to drill the tieback hole. On either side of the H-pile inside the flanges where the pile is cut to allow the tie back to go through, stiffener plates are installed (usually measuring 24" length wise×13" wide×½" thick) centered about the hole. This process leaves a void in the soil around the tiebacks which is later filled in with additional lean shotcrete. Once the tieback holes are drilled to the specified depths, the tieback tendons are installed. The tiebacks are then pressure grouted using Type I or II cement prepared with potable water (at a water/cement ration of about 0.45). Generally, the tieback's are pressure grouted several times to reach pressure in the range of about 150 to 300 psi. Once the pressure has been reached the tiebacks are allowed to set for several days prior to stressing.

Upon completion of stressing of the permanent tiebacks, the protruding strands are cut off near the wedges. Next, the tieback head is cleaned of any loose and deleterious material and mastic is applied around the edges. Next the tieback head is covered with a tieback waterproofing cover. This cover is then primed with the liquid adhesive coating solution. Next, fabric tape is applied over the cover in strips until all of the unit is covered. The fabric is then primed again with the liquid adhesive coating solution and then mastic is applied to all seams and joints.

For temporary tiebacks a different approach is used. Once the tieback has been pressure grouted a steel head with a circular threaded protruding shaft is placed over the strands and welded to the face of the pile at the design angle of the tendon. Next, a circular PVC fitting is screwed into the steel head circular threaded protruding shaft. A 3-piece unit consisting of a short section of PVC pipe (~4 inches long) glued into a coupling, glued into a longer section of PVC pipe (~14 inches long) is then inserted into the threaded PVC fitting at the base. The 3-piece unit is a temporary covering to protect the tieback strands during placement of the final 10" shotcrete wall. Prior to shotcreting the unit is coated in a greasing agent to allow removal from the concrete at a later time. Only the steel head and threaded PVC fitting at the based is waterproofed and not the 3-piece removable unit. This detail is waterproofed by first roughening the PVC pipe threaded coupling at the base and cleaning off the steel head unit. The area is then primed with liquid adhesive coating solution. Next, a 12×12 inch piece of fabric tape with a cut in the center is placed over the steel head and pressed against the PVC coupling. The fabric tape is then primed and mastic is applied to about 3 inches off the face of the pile. A small piece of water stop is then placed around the circumference of the pipe. Once the concrete is set and the temporary 3-piece assembly has been removed, the tie back is stressed. This is done by placing a 16×16 inch steel plate with a trumpet over the tendons and stressing the tieback against the permanent shotcrete wall face. Once the structure is in place to support the shoring wall system, the strands are cut, the steel head plate and trumpet removed, a PVC cap is screwed into the threaded coupling, and the hole is patched with concrete.

Figure 7:
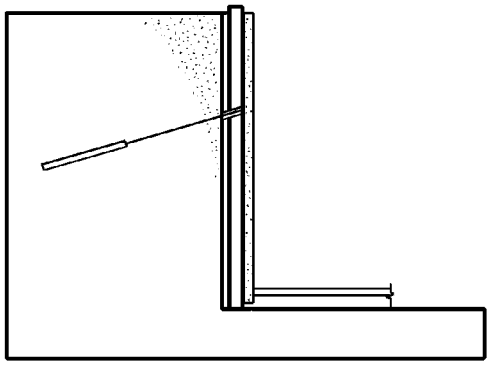
FIG. 7 is a schematic illustration of a step portion of the method of FIG. 1, showing the construction of subsequent lifts to complete the construction of the in-ground foundation wall and showing the optional connection of the foundation wall to a drainage device.

Step 800—Completion of the Final Lift—As shown in FIG. 7, the excavation progresses in approximately 5-foot deep lifts until the bottom elevation of the excavation is reached. At this point, measures should be taken to collect and discharge water that reaches the drainage composite. A pipe or higher flow composite is connected to the bottom of the drainage composite. Preferably, flow from the collector is either routed through penetrations in the concrete lagging to other drain lines required for the building, or if possible they can be extended beyond the end of the wall to tie in to other site drainage features.

Optionally, at the lowest levels of the shoring wall the detail changes slightly regarding the waterproofing detail. The drainage board material ties into a higher flow drainage board material at the base of the wall. This higher flow material is placed in between the H-pile bays at the toe of the initial drainage board layer beneath the mudsill (when required) and is placed continuously at the toe of the main drainage board at the lowest levels of the wall. The higher flow material is spliced into the regular drainage board material above by butting them together with underlying filter fabric material. In every bay, a system of "T" connectors attaches the back layer of drainage board to the front layer and may tie into a permanent under drain system or daylight by some other means.

Figure 8:
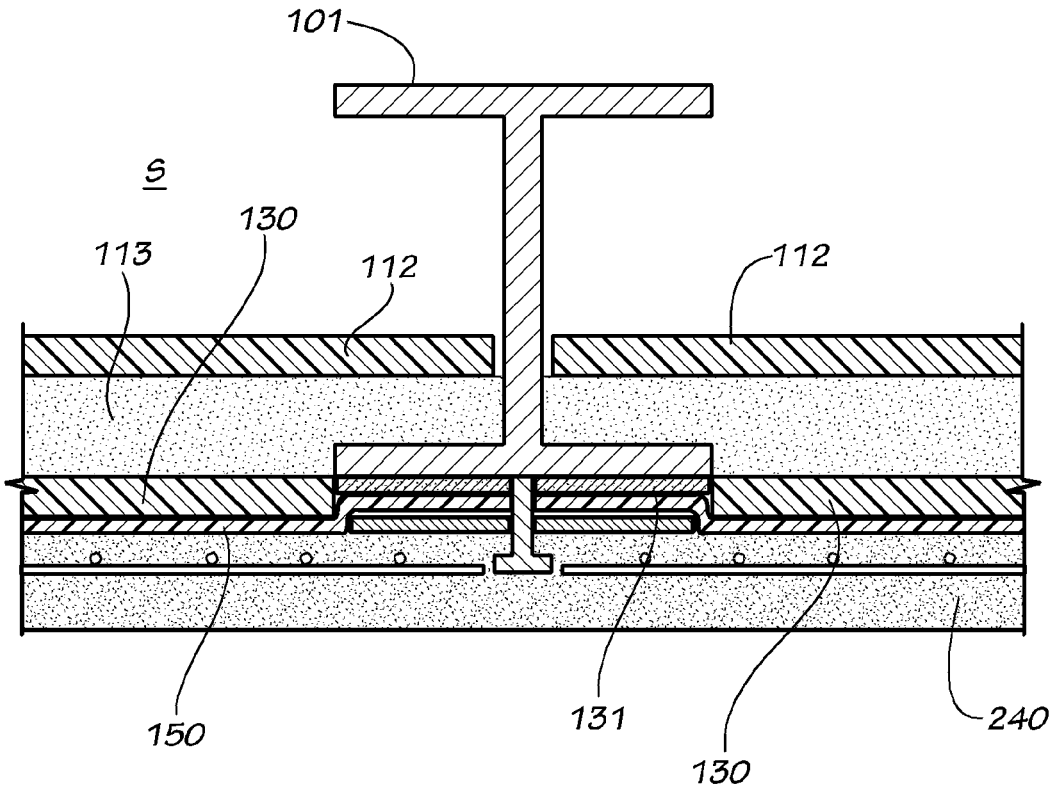
FIG. 8 is a schematic, top sectional view of an example of an in-ground foundation wall constructed according to the method of FIG. 1.

A foundation wall constructed according to one or more of the principles set out herein can have the general appearance of that shown in FIG. 8. As shown therein, the pile 101 is set in the soil S and is straddled by a first series of plastic drainage boards 112. A relatively thin (2-4 inches) concrete mudsill wall 113 abuts the first plastic drainage boards and surrounds part of the H-pile. A series of second plastic drainage boards 130 extend between adjacent H-piles, but do not overlay the H-piles. An adhesive layer 131 helps bond a waterproof membrane 150 to the H-piles and the membrane 150 spans the H-piles and the series of second plastic drainage boards 130, while extending around the headed studs 140 protruding therethrough. Fabric tape 160 and mastic help seal the membrane 150 near the headed studs 140. A thicker (typically 6-10 inches thick) layer 240 of reinforced concrete is positioned against the membrane 150, being reinforced by a grid 230 of vertical and horizontal rebar and secured fore and aft by the headed studs 140.

It is to be understood that this invention is not limited to the specific devices, methods, conditions, or parameters of the example embodiments described and/or shown herein, and that the terminology used herein is for the purpose of describing particular embodiments by way of example only. Thus, the terminology is intended to be broadly construed and is not intended to be unnecessarily limiting of the claimed invention. For example, as used in the specification including the appended claims, the singular forms "a," "an," and "the" include the plural, the term "or" means "and/or," and reference to a particular numerical value includes at least that particular value, unless the context clearly dictates otherwise. In addition, any methods described herein are not intended to be limited to the sequence of steps described but can be carried out in other sequences, unless expressly stated otherwise herein.

While the claimed invention has been shown and described in example forms, it will be apparent to those skilled in the art that many modifications, additions, and deletions can be made therein without departing from the spirit and scope of the invention as defined by the following claims. For example, while the drawings and description show and describe the exemplar use of H-piles, other shapes of piles can be employed, as known in the art.

What is claimed is:

1. A method of constructing a waterproof foundation wall system in the ground, the method comprising the steps of:

(1) installing a series of spaced-apart vertical structural steel beams in the ground; and (2) beginning at a first level of the structural steel beams and working downwardly, making the foundation wall in multiple horizontal sections, one horizontal section at a time from top to bottom, each horizontal section made by:

(a) excavating soil between 4 and 8 feet to provide a limited excavated space for constructing a portion of a concrete wall;

(b) positioning a waterproof cladding in the excavated space; and (c) constructing a concrete wall portion spanning the vertical structural steel beams such that the waterproof cladding is positioned against the concrete wall portion.

2. The method of claim 1 further comprising the step of constructing an outer wall in the excavated space and spanning the vertical structural steel beams, and wherein the step of positioning the waterproof cladding comprising applying the waterproof cladding against the outer wall, such that when the concrete wall portion is constructed, the waterproof cladding is sandwiched between the concrete wall portion and the outer wall.

3. The method of claim 1 wherein the step of excavating soil comprises excavating down between about 5 and 6 feet to provide a limited excavated space for constructing a portion of a concrete wall.

4. The method of claim 1 wherein the step of constructing the concrete wall portion comprises positioning steel reinforcing bars and then surrounding the steel reinforcing bars with liquid concrete.

5. The method of claim 4 wherein the step of surrounding the steel reinforcing bars with liquid concrete comprises spraying liquid shotcrete.

6. The method of claim 4 wherein the step of positioning steel reinforcing bars comprises welding shear studs to the vertical steel beams at regular intervals and supporting a grid of steel reinforcing bars upon the shear studs.

7. A method of constructing a waterproof foundation wall system in the ground, the method comprising the steps of:

(1) installing a series of spaced-apart vertical structural steel beams in the ground; and (2) beginning at a first level of the structural steel beams and working downwardly, making the foundation wall in multiple horizontal sections, one horizontal section at a time from top to bottom, each horizontal section made by:

(a) excavating soil between 4 and 8 feet to provide a limited excavated space for constructing a portion of a concrete wall;

(b) positioning a waterproof cladding in the excavated space; and (c) constructing a concrete wall portion spanning the vertical structural steel beams such that the waterproof cladding is positioned against the concrete wall portion wherein the step of excavating soil comprises excavating a continuous shallow trench about 1 to 2 feet deep at the bottom of the excavation adjacent to where the wall is being constructed to allow vertical overlapping of drainage, waterproofing and reinforcing steel from one horizontal section to another.

8. The method of claim 7 further comprising the step of constructing an outer wall in the excavated space and spanning the vertical structural steel beams and wherein the step of constructing an outer wall comprises installing a concrete lagging wall, and the method further comprises installing a prefabricated drainage composite material behind the concrete lagging wall to prevent the build-up of excess hydrostatic pressure behind the concrete lagging wall, and wherein the prefabricated drainage composite material is placed more or less continuously over the excavated earth face adjacent the concrete lagging wall and extends below the base of the horizontal wall section into the shallow trench to allow it to lap behind the next horizontal wall section.

9. A method of constructing a waterproof foundation wall system in the ground, the method comprising the steps of:

(1) installing a series of spaced-apart vertical structural steel beams in the ground; and (2) beginning at a first level of the structural steel beams and working downwardly, making the foundation wall in multiple horizontal sections, one horizontal section at a time from top to bottom, each horizontal section made by:

(a) excavating soil between 4 and 8 feet to provide a limited excavated space for constructing a portion of a concrete wall;

(b) positioning a waterproof cladding in the excavated space; and (c) constructing a concrete wall portion spanning the vertical structural steel beams such that the waterproof cladding is positioned against the concrete wall portion;

the method further comprising the step of constructing an outer wall in the excavated space and spanning the vertical structural steel beams;

wherein the step of constructing an outer wall comprises installing a concrete lagging wall, and the method further comprises installing a prefabricated drainage composite material behind the concrete lagging wall to prevent the build-up of excess hydrostatic pressure behind the concrete lagging wall.

* * * * *